US008801553B2

(12) United States Patent
Fujikura et al.

(10) Patent No.: US 8,801,553 B2
(45) Date of Patent: Aug. 12, 2014

(54) SPORTS BALL

(75) Inventors: Takashi Fujikura, Hiroshima (JP); Osamu Kobayashi, Hiroshima (JP); Shuzo Matsuno, Hiroshima (JP)

(73) Assignee: Mikasa Corporation, Hiroshima-shi, Hiroshima (JP)

( * ) Notice: Subject to any disclaimer, the term of this patent is extended or adjusted under 35 U.S.C. 154(b) by 0 days.

(21) Appl. No.: 13/134,719

(22) Filed: Jun. 15, 2011

(65) Prior Publication Data

US 2012/0004058 A1 Jan. 5, 2012

(51) Int. Cl.
*A63B 41/00* (2006.01)

(52) U.S. Cl.
USPC ..... 473/605; 473/599; 473/604

(58) Field of Classification Search
USPC ..... 473/599, 604, 605, 614
See application file for complete search history.

(56) References Cited

U.S. PATENT DOCUMENTS

| | | | | |
|---|---|---|---|---|
| 2,194,132 | A * | 3/1940 | Voit et al. | 156/147 |
| 2,352,872 | A * | 7/1944 | Voit et al. | 473/605 |
| 2,688,488 | A * | 9/1954 | Crowley | 473/605 |
| 2,945,693 | A * | 7/1960 | Way | 473/605 |
| 2,995,311 | A * | 8/1961 | Holman | 242/435.2 |
| 4,239,568 | A | 12/1980 | Takazawa | |
| 5,580,049 | A * | 12/1996 | Brantley | 473/599 |
| 5,772,545 | A * | 6/1998 | Ou | 473/605 |
| 6,503,162 | B1 * | 1/2003 | Shishido et al. | 473/605 |
| 2003/0130076 | A1 * | 7/2003 | Lacroix et al. | 473/593 |

FOREIGN PATENT DOCUMENTS

| | | |
|---|---|---|
| EP | 0 894 514 A2 | 2/1999 |
| EP | 1 424 105 A1 | 6/2004 |
| JP | 27-312 | 1/1957 |
| JP | 36-031132 | 11/1961 |
| JP | 58-029112 B | 6/1983 |

OTHER PUBLICATIONS

Japan Patent Office, Office Action in Japanese Patent Application No. 2010-139557, Oct. 15, 2013.
European Patent Office, Extended Search Report for European Patent Application No. 11 169 996.3, Mar. 11, 2014, Munich, Germany.

* cited by examiner

*Primary Examiner* — Vishu K. Mendiratta
(74) *Attorney, Agent, or Firm* — Taft Stettinius & Hollister LLP

(57) ABSTRACT

There is provided a sports ball capable of relieving the pain of the hands suffered from impact on the ball and having a soft feel and high flexibility. The sports ball comprises a spherical hollow rubber bladder (2) inflated with air injected into it, a fabric tape reinforcement layer (3) formed by winding a narrow adhesive-impregnated fabric tape (7) around a central spherical portion (6) of the rubber bladder about each of three axes of the rubber bladder with the exception of opposite spherical end portions (5) of the rubber bladder, whereby the fabric tape reinforcement layer is formed as orthogonal lap windings of the fabric tape over substantially all of the spherical surface of the rubber bladder, to provide a fabric tape wound ball core, and surface panels (4) adhered with adhesive to the fabric tape reinforcement layer on the rubber bladder, after vulcanization and forming of the fabric tape wound ball core.

3 Claims, 4 Drawing Sheets

SPORTS BALL

This invention relates to a sports ball such as a soccer ball, a basketball, volleyball, or a handball, and particularly, to such a ball with fabric windings therein.

BACKGROUND AND SUMMARY OF THE INVENTION

It has been known that sports balls including athletic balls are manufactured by adhering cloth pieces to the surface of a hollow spherical rubber bladder inflated with air injected into it, to form a cloth reinforcement layer on the bladder, or by winding around the surface of such a rubber bladder a synthetic fiber yarn impregnated with latex adhesive solution, to form a yarn winding reinforcement layer on the bladder, and by adhering surface panels to the overall surface of the cloth or yarn winding reinforcement layer after vulcanizing and forming the rubber bladder with the reinforcement layer; or as disclosed in Patent Publication Sho58-29112 (Patent Document 1), by forming a hollow sphere from fragile material such as paraffin, forming a cloth bag from cloth pieces adhered doubly to the outer surface of the hollow sphere, taking the hollow sphere out of the cloth bag through an opening formed by cutting out a portion of the cloth bag, inserting a rubber bladder through the opening into the cloth bag, stacking a rubber sheet on overlapped end portions of the adjacent cloth pieces of the bag after the rubber bladder is inflated with air injected into it, forming the rubber sheets into ridge-like ribs by vulcanizing and forming them, and adhering surface panels to the surface of the cloth pieces on the bladder along the ridge-like ribs.

The former ball has the advantage of improved strength of the ball, due to the fact that the bladder is reinforced with the yarn windings or the cloth pieces, whereas the latter ball has the advantage of being capable of absorbing impact from the exterior due to separation of the outer surface of the bladder from the inner surface of the cloth bag in which the bladder is inserted.

However, the former ball has a hard feel and high impact force due to the triple layers of rubber bladder, yarn winding or cloth reinforcement layer, and the surface panels in a stacked and adhered state, whereas the latter ball has a soft feel due to separation of the bladder from the cloth bag as disclosed above, but the requirement of complicated steps for manufacture of the cloth bag results in low production efficiency.

It is disclosed in Utility Model Publication Sho36-31132 (Patent Document 2) that there is provided an athletic ball manufactured by winding, at random, a fabric tape around the outer surface of a spherical hollow rubber bladder inflated with air injected into it, sticking surface rubber on the wound fabric tape and vulcanizing and forming the whole. This ball has better production efficiency as compared with the ball with the yarn windings or the cloth, since the fabric tape is wound around and stuck on the outer surface of the rubber bladder, but the fabric tape wound around the rubber bladder at random and stuck on it, has the disadvantage of losing the function of absorbing impact force exerted on the ball, due to lost directional property of the cloth construction. In this prior art, heat vulcanization of the whole, including the surface rubber, further facilitates a hard feel.

Patent Document 1: Patent Publication Sho58-29112

Patent Document 2: Utility Model Publication Sho36-31132

An object of the present invention is to provide a sports ball capable of relieving the pain of the hands suffered from impact on the ball and having a soft feel and high flexibility.

This object of the invention can be achieved by providing a sports ball comprising a spherical hollow rubber bladder inflated with air injected into it, a fabric tape reinforcement layer formed by winding a narrow adhesive-impregnated fabric tape around a central spherical portion of the rubber bladder about each of three axes of the rubber bladder, with the exception of opposite spherical end portions of the rubber bladder, whereby the fabric tape reinforcement layer is formed as orthogonal lap windings of the fabric tape over substantially all of the spherical surface of the rubber bladder to provide a fabric tape wound ball core, and surface panels adhered with adhesive to the fabric tape reinforcement layer on the rubber bladder after vulcanization and forming of the fabric tape wound ball core.

According to the invention, the fabric tape is wound around the rubber bladder with the wound adjacent portions of the fabric tape overlapping each other by ½ of the width of the fabric tape, such that two layers are formed per each of the three axes of the rubber bladder. The fabric tape preferably is comprised of cotton, or polyester, or mixed fabric of cotton and polyester, or hemp, or mixed fabric of hemp and polyester. The fabric tape preferably has a width of about 10% of a diameter of the rubber bladder.

In a preferred embodiment of the invention, the surface panels each may comprise a urethane layer, backed by a foam sponge layer.

DETAILED DESCRIPTION OF THE INVENTION

Figure 1:
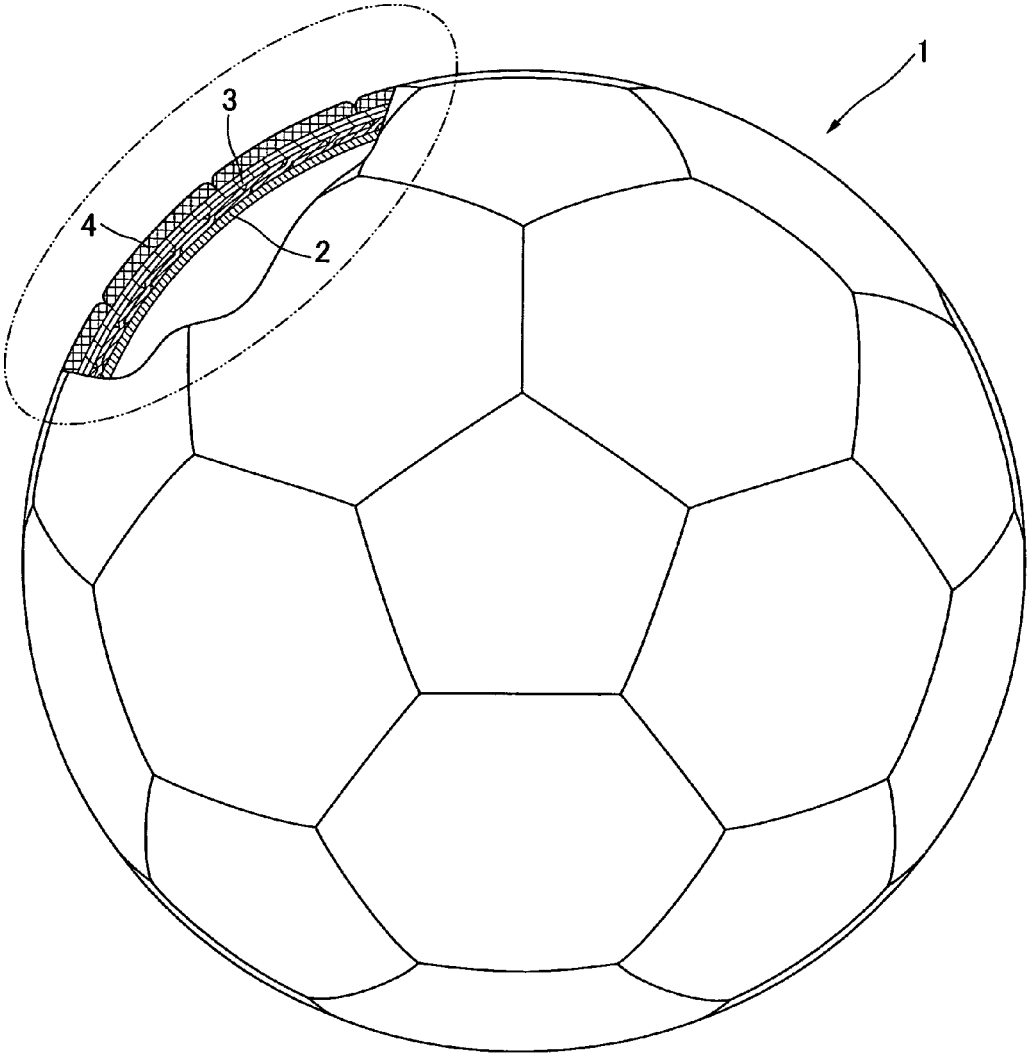
FIG. 1 is a perspective view of a sports ball according to the invention with a portion thereof cut away.

Referring to FIG. 1 of the drawings, there is shown a sports ball 1 according to the invention with a portion thereof shown in section, and comprising a rubber bladder 2 to form a ball core, a fabric tape reinforcement layer 3 for reinforcing the rubber bladder 2, and surface panels 4 adhered to the fabric tape reinforcement layer.

In particular, the rubber bladder 2 comprises a spherical hollow body inflated with air injected into it. The fabric tape reinforcement layer 3 is formed by winding an adhesive-impregnated narrow fabric tape 7 around central spherical portions 6 of the rubber bladder about each of three mutually orthogonal axes X, Y, Z of the bladder, with exception of its opposite spherical end portions 5, and adhering the fabric tape 7 to the central spherical portion of the rubber bladder.

Figure 2:
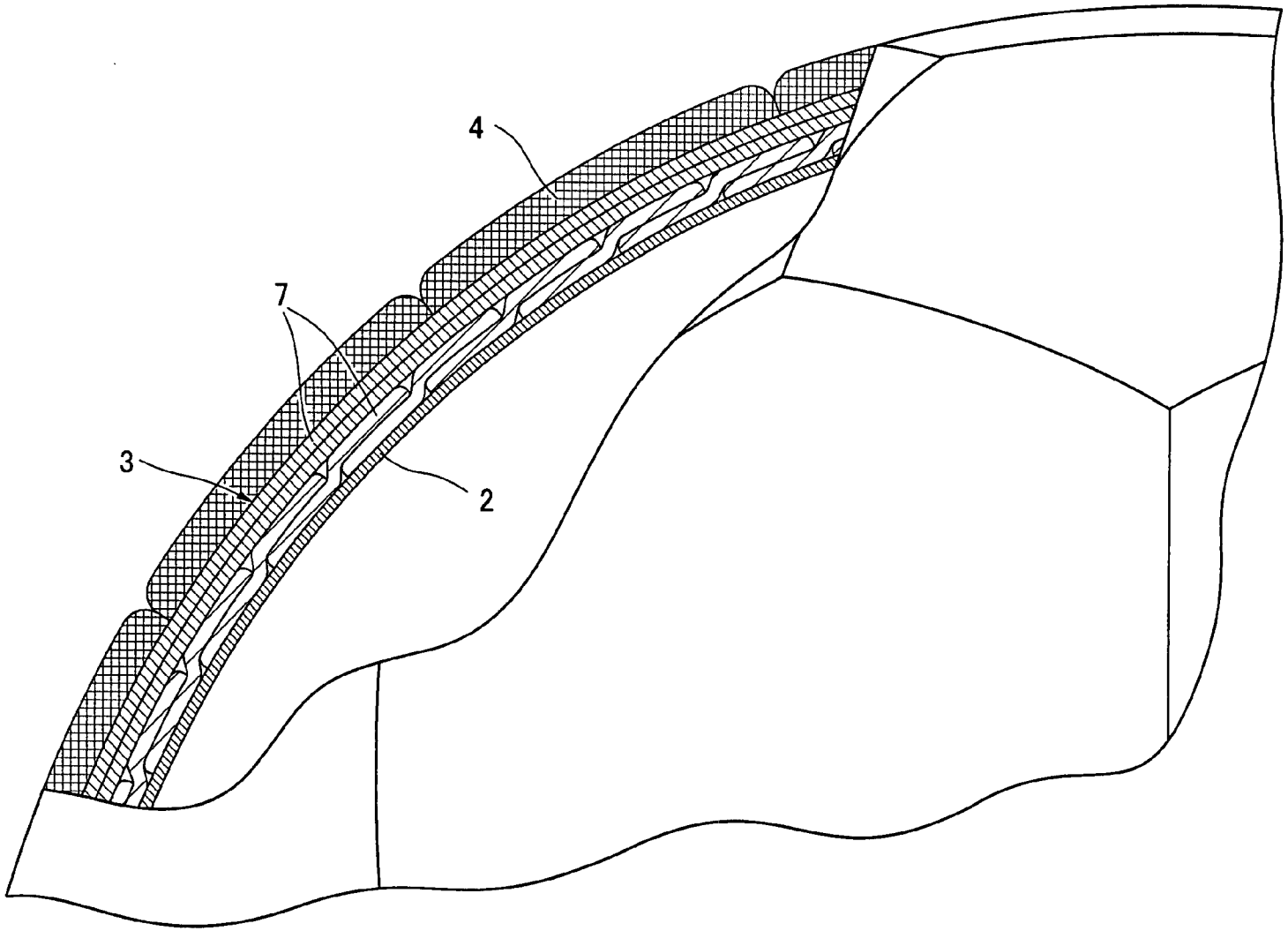
FIG. 2 is an enlarged fragmental view in section of the ball shown in FIG. 1.
Figure 3:
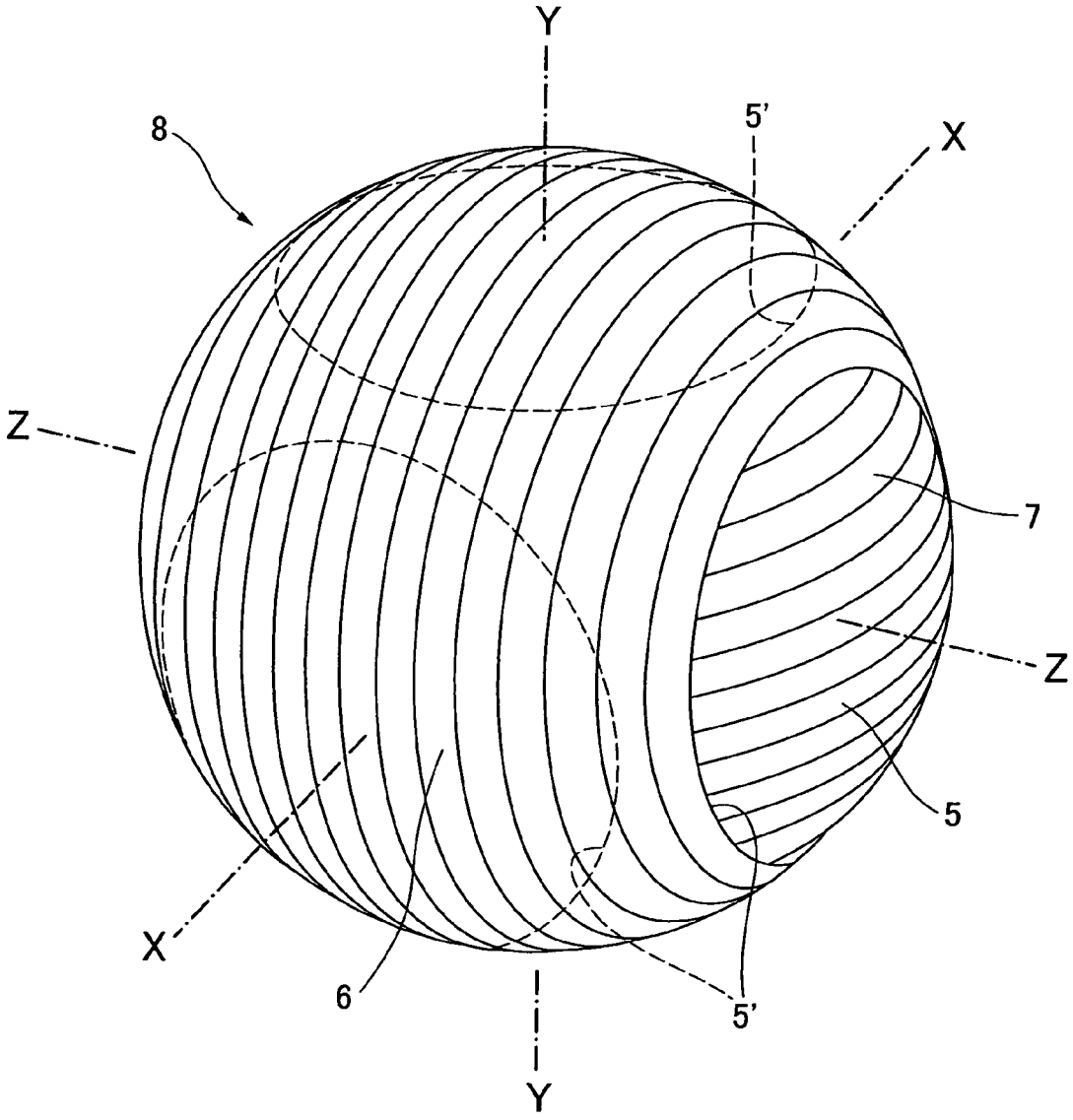
FIG. 3 is a perspective view of a fabric tape wound ball core to be used for the sports ball according to the invention.
Figure 4:
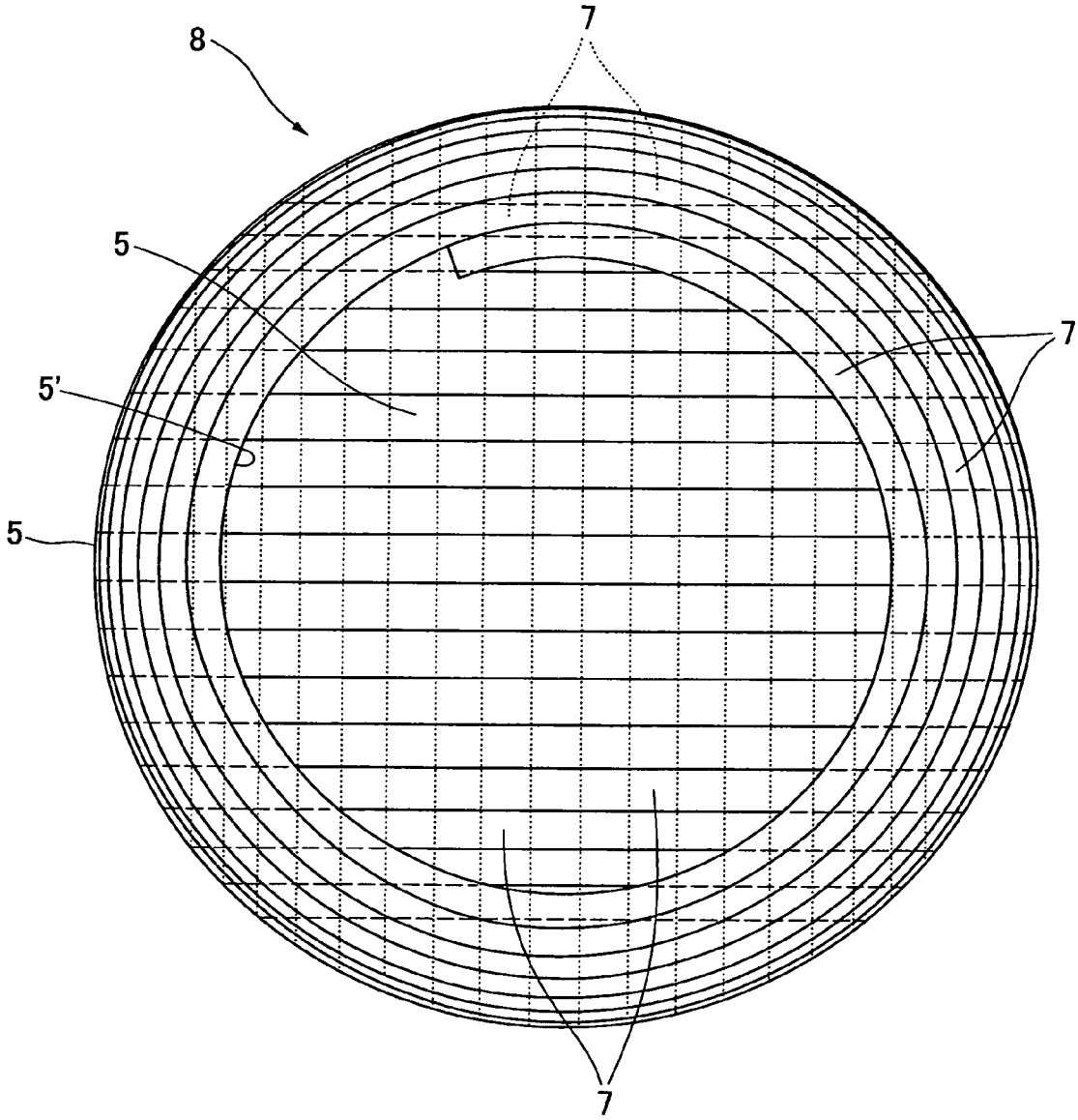
FIG. 4 is a top plan view of the fabric tape wound ball core.

With this arrangement, since the opposite spherical end portions 5 at each of the axes are covered by the fabric tape 7 wound around the central spherical portion of the bladder about its axis in turn, the fabric tape reinforcement layer 3 is formed as mutually orthogonal lap windings of the fabric tape over substantially all of the spherical surface of the rubber bladder 2. The fabric tape 7 is wound around the rubber bladder 2 as a single layer per each of the axes of the bladder, but since, as shown in FIG. 2, the fabric tape is overlapped by ½ of the width of the fabric tape during winding, the fabric tape around the rubber bladder 2 forms two layers of the fabric tape. Thus, the mutually orthogonal lap windings of the fabric tape comprise four layers.

In view of the fact that the fabric tape is wound around the rubber bladder about the three axes, a portion of the bladder surrounded by its three spherical end portions adjacent to one another has three layers (six layers due to the overlapped windings), but since this portion is small in area as compared with the entire spherical surface of the ball, this does not affect the sphericity of the ball. Thus, there is provided a fabric tape wound ball core 8 formed by winding the fabric tape around the rubber bladder with directionality and in a regular manner.

The fabric tape 7 preferably may be of cotton, or polyester, or mixed fabric of cotton and polyester, or hemp, or mixed fabric of hemp and polyester. The fabric tape preferably may have a width of about 10% of a diameter (about 20 cm, for example,) of the rubber bladder 2. If the width of the fabric tape is more than 10% of the diameter of the rubber bladder, the fabric tape could not accommodate the spherical surface of the bladder when the fabric tape is wound around the bladder, causing formation of an irregular reinforcement layer. A width of the fabric tape that is less than 10% of the diameter of the bladder would result in increase in overlapped portions of the fabric tape, such that irregularities are likely to occur on the adhered surface panels. For these reasons, the width of the fabric tape as described above has been determined.

The adhesive with which the fabric tape is impregnated preferably may comprise an aqueous adhesive of natural rubber latex or urethane rubber.

The fabric tape wound ball core 8 is then received in a mold and subject to vulcanization and forming in accordance with a conventional process. Surface panels 4 are adhered with adhesive to the outer surface of the fabric tape reinforcement layer 3 on the vulcanized ball core 8, to provide a sports ball according to the invention. The surface panels each preferably may comprise a urethane sheet backed by a foam sponge layer. In order to insure durability and rebound characteristics of the ball, use of the soft surface panels can lead to durability of the reinforcement layer and to rebound characteristics of the rubber bladder. The adhesive to be used for adhesion of the surface panels 4 to the reinforcement layer may be of chloroprene rubber or natural rubber latex, urethane rubber or the like.

According to the invention, there is provided a sports ball having improved rebound characteristics and increased durability. Since narrow fabric tape is wound in an orderly way around and adhered to substantially the entire spherical surface of the reinforcement layer of the rubber bladder, the directional property of the fabric construction of the fabric tape is maintained, to exhibit the function of relieving impact force on the ball. Thus, the ball has a soft feel, like a ball with a cloth winding.

The invention claimed is:

1. A sports ball, comprising:

a spherical hollow rubber bladder inflated with air injected into it, and about each of three axes of the spherical rubber bladder, a narrow adhesive-impregnated fabric tape wound around a central spherical portion of the rubber bladder, with the exception of opposite end portions of the rubber bladder to form a fabric tape reinforcement layer, wherein:

the fabric tape reinforcement layer consists of three mutually orthogonal lap windings of the fabric tape to provide a fabric tape wound ball core, in each one of the three fabric tape lap windings, each of the adjacent lap portions of the wound fabric tape has its edge positioned to be parallel to an edge of its adjacent lap portion, and in each one of the three fabric tape lap windings, each of the adjacent lap portions of the wound fabric tape has its edge positioned to overlap its adjacent lap portion at all points by one-half of a width of the fabric tape, such that the mutually orthogonal lap windings around the central spherical portion of the rubber bladder with the exception of opposite end portions of the rubber bladder form four layers of fabric tape over substantially all of the spherical surface of the rubber bladder.

2. A sports ball according to claim 1, wherein the fabric tape is comprised of cotton, polyester, mixed fabric of cotton and polyester, hemp, or mixed fabric of hemp and polyester.

3. A sports ball according to claim 1, wherein the fabric tape has a width of about 10% of a diameter of the rubber bladder.

* * * * *